US005327681A

United States Patent [19]

Minami

[11] Patent Number: 5,327,681

[45] Date of Patent: Jul. 12, 1994

[54] GUIDE RAIL DEVICE FOR HANGING DOORS

[75] Inventor: Saburo Minami, Osaka, Japan

[73] Assignee: Osaka Kanagu Co., Ltd., Osaka, Japan

[21] Appl. No.: 975,443

[22] Filed: Jan. 17, 1992

[51] Int. Cl.[5] ..... E05D 13/00

[52] U.S. Cl. ..... 49/411; 49/304

[58] Field of Search ..... 49/411, 410, 414, 304, 49/305; 16/90

[56] References Cited

U.S. PATENT DOCUMENTS

| | | | |
|---|---|---|---|
| 3,332,167 | 7/1967 | Fayer | 49/410 X |
| 3,756,302 | 9/1973 | Sivin | 49/410 X |
| 4,598,499 | 7/1986 | Viner | 49/411 |
| 4,688,490 | 8/1987 | Burleson | 49/411 X |

FOREIGN PATENT DOCUMENTS

| | | | |
|---|---|---|---|
| 588007 | 5/1977 | Switzerland | 49/410 |

*Primary Examiner*—Philip C. Kannan

*Attorney, Agent, or Firm*—Wenderoth, Lind & Ponack

[57] ABSTRACT

A guide rail device is provided for hanging doors. The device is effective to accurately guide the hanging door without deviation, yet does not project up from the floor when the doors are open, as is the case with a guide rail or a groove-rail mounted on the floor surface. When the hanging doors are open, guides of the device are retracted into a guide rail in the floor surface and thus do not project from the floor surface. When the hanging doors are closed, the guides are projected from the floor surface and are fitted in a long groove from in a bottom end surface of the hanging doors, such that the hanging doors are prevented from deviating while being moved.

14 Claims, 9 Drawing Sheets

GUIDE RAIL DEVICE FOR HANGING DOORS

BACKGROUND OF THE INVENTION

1. Field of the Invention

This invention relates to a guide rail device for hanging doors by which the hanging door is led accurately without the provision of a guide rail or grooved rail which conventionally projects from the floor surface.

2. Description of the Prior Art

The conventional guide rail device for hanging doors is of such type that a door is hung from an upper fixed rail by means of a hanger, a lower end portion of the door is made free or is inserted in a grooved rail disposed at the floor surface. When the door is opened or closed, it is guided by the upper rail and the grooved rail.

In the case where the hanging door is hung from and supported by the upper rail alone, there is neither a projection nor a groove at the floor surface for guiding or supporting the lower part of the hanging door. Therefore, when the hanging door is opened, the floor surface is neat but on the other hand, since the lower part of the hanging door is not fixed, the hanging door is liable to deviate from its straight moving direction when it is opened or closed. In order to avoid such deviation of the hanging door, it has been devised to lay a rail at the floor surface and to fit a deviation-preventing piece (provided at the lower end of the hanging door) in the rail. In this case, deviation is prevented but a rail-like projection at the floor surface will spoil the beauty of the floor surface or can cause a man walking to stumble over it. In the case of a grooved rail, a man walking will stumble over it or dust will collect in the groove rail, with the result that the beauty of the floor surface is spoiled.

SUMMARY OF THE INVENTION

An object of the present invention is to provide a guide rail device for hanging doors which does not require provision of a projection, such as a rail, or a groove at the floor surface and with which the door can be opened and closed accurately with no deviation.

In order to attain the above object, the guide rail device according to the present invention has the following construction.

Guides are provided visibly and invisibly at required intervals in a guide rail embedded in the floor surface along the direction in which the hanging door moves. A long groove in which the guides can be fitted is formed in the undersurface of the hanging door. When the hanging door moves, the guides are caused to project from or enter into the floor surface by means of a link mechanism. When the hanging door is opened or closed, immediately before the hanging door is located at the guide, the guide projects above the floor surface and is fitted in the long groove of the hanging door, whereby the hanging door is prevented from deviating and is guided accurately. When the hanging door stops above the guide, the guide maintains its projecting state but when the hanging door is moved to the opening position, the guide is forced to retract into the guide rail, to a level substantially flush with the floor surface, by means of a link mechanism. Thus, when the hanging door is fully open, there is no projection on the floor surface and accordingly there is no danger of a man stumbling over a projection.

BRIEF DESCRIPTION OF THE DRAWINGS

The nature and advantages of the present invention will be understood more clearly from the following description made with reference to the accompanying drawings, in which:

FIG. 1.4 is an explanatory drawing of a second embodiment of the invention;

DETAILED DESCRIPTION OF THE INVENTION

Figure 1:
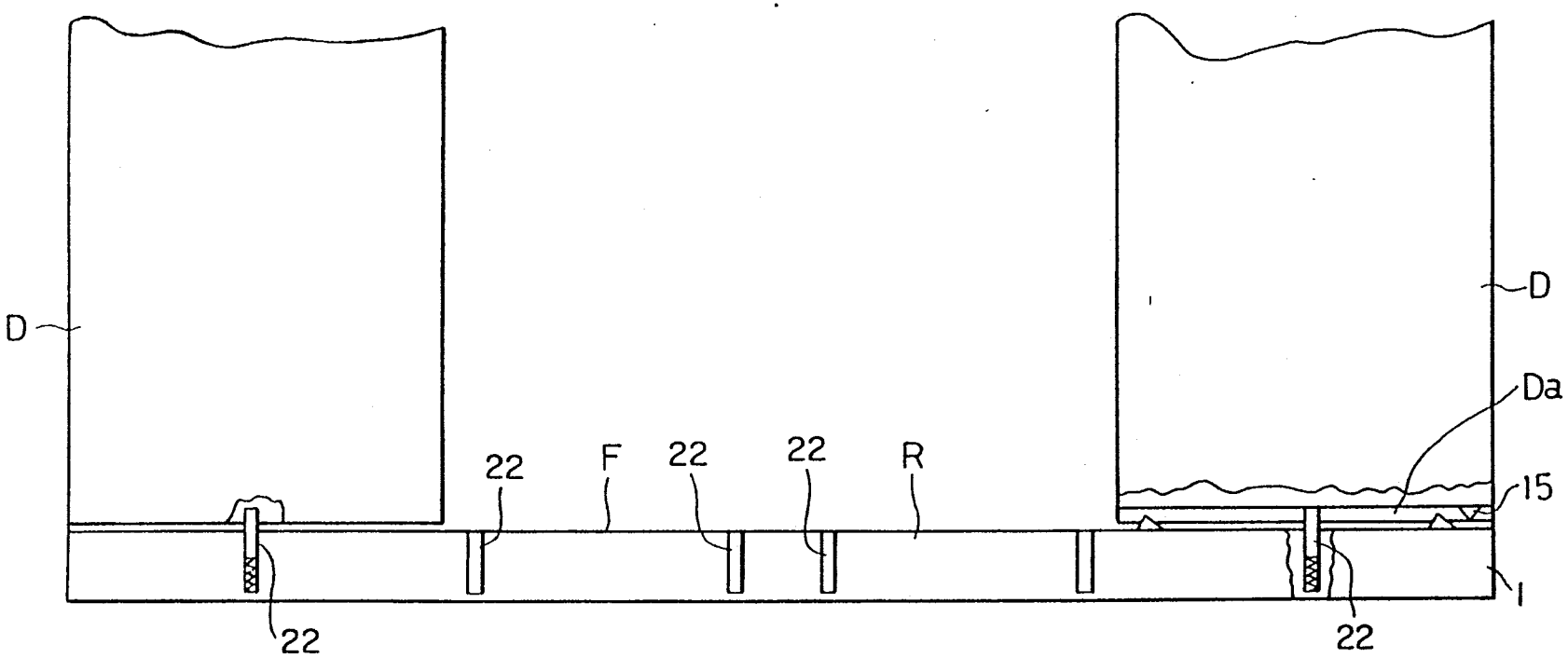
FIG. 1 is a front view of the device of the present invention at the time when doors are fully opened.

A description is made below of the present invention on the basis of embodiments shown in the drawings.

In the drawings, R designates a guide rail which accurately guides a hanging door D hung from an upper rail. This guide rail R is embedded in the floor on the same level (i.e. flush) with the floor surface F and along the moving direction of the hanging door D.

Figure 5:
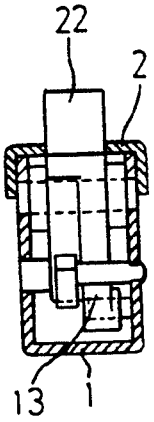
FIG. 5 is a cross section view of the differential cam in FIG. 4.

The guide rail R which is provided at the floor surface in the moving direction of the hanging door D comprises a rail main body 1, which is C-shaped or U-shaped in cross section (as shown in FIG. 5) and a lid piece 2 which covers an open upper end of the rail main body 1. The guide rail R has a length corresponding to the length from the fully closed position to the fully open position of the hanging doors D. The lid piece 2 has a plurality of holes formed at required intervals so as to allow guides 10A, which are to extend into a long groove formed in the undersurface of the hanging door along the moving direction of the hanging door, to appear and disappear when the hanging door is fully open. Guide 10A (or 10B) shown in FIG. 7 (or FIG. 8) are mounted in positions corresponding to these holes.

An operational link 11 is arranged in the rail main body 1 along its lengthwise direction. A part of a differential cam 12 is pivotably mounted to an end of the operational link 11 through a pivot pin P1. Each guide 10A is coupled to the operational link 11 through a link 13 shown in FIG. 10. Upon rotation of the differential cam 12 about a pivot 14, all guides simultaneously project from or retract into the top surface of the guide rail, namely, the floor surface.

Figure 4:
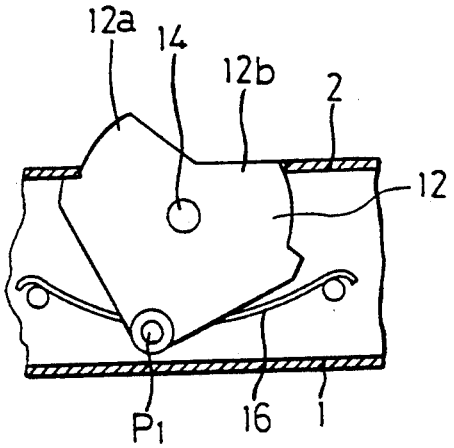
FIG. 4 is a front view of a differential cam.
Figure 6:
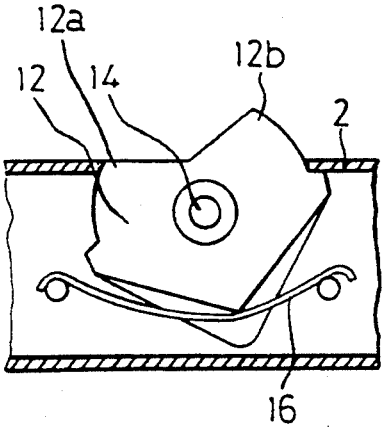
FIG. 6 is a back view of the differential cam shown in FIG. 4.
Figure 10A:
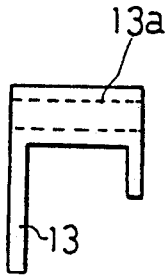
FIGS. 10(A) and (B) are side and front views, respectively, of a link.
Figure 10B:
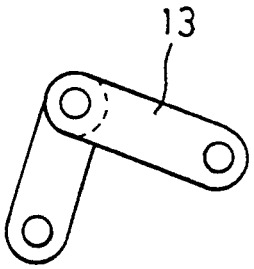

The differential cam 12 is rotatably mounted in the rail main body 1 by the pivot 14, and a top surface of the cam 12 is formed with a flattened V-shape as shown in FIG. 4 and FIG. 6, so that either of its left and right peaks 12*a*, 12*b* projects slightly from the top surface of the rail main body 1. Rotation of the operational cam 12 is caused when either of the peaks 12*a*, 12*b* is contacted by an operational projection 15 projecting downwardly from an inner ceiling surface of a long groove Da formed in the undersurface of the hanging door D. A leaf spring 16 is coupled to the differential cam 12 so that the cam 12 automatically tilts either fully leftward or fully rightward when it passes beyond the dead point. As shown in FIG. 10, the link 13 is L-shaped and a boss 13*a* is formed at a bent part at the center (i.e. at the elbow of the link 13). The link 13 is pivotably mounted to the rail main body 1 for pivoting about an axis passing through the boss 13*a*; and one end of the link 13 is coupled to the operational link 11 and the other end thereof is coupled to the guide 20.

Figure 7:
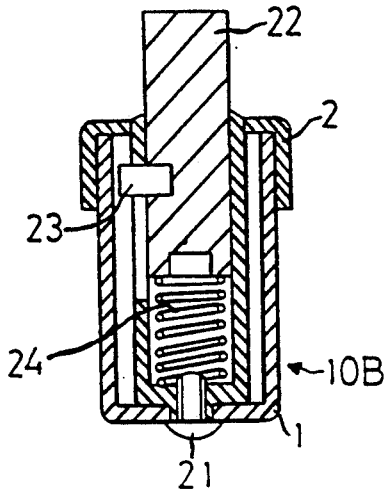
FIG. 7 is a cross section view of a guide.
Figure 8:
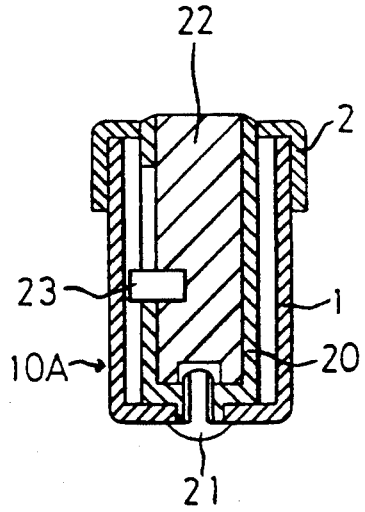
FIG. 8 is a cross section view of another guide without a spring.
Figure 9:
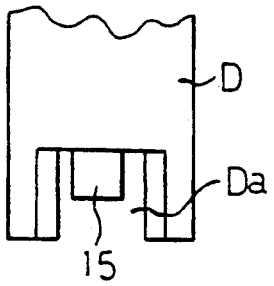
FIG. 9 is a side view of a lower end part of the hanging door.
Figure 11A:
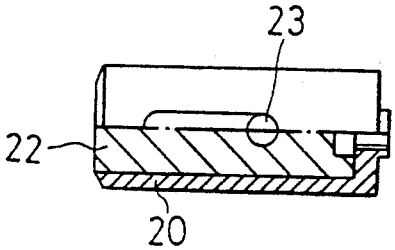
FIGS. 11(A) and (B) are explanatory drawings of the guide shown in FIG. 8.
Figure 11B:
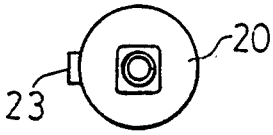
Figure 12A:
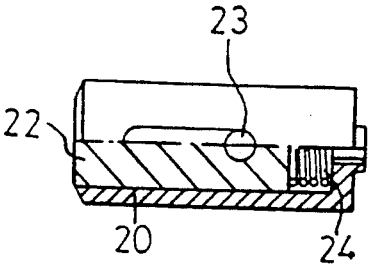
FIGS. 12(A) and (B) are explanatory drawings of the guide shown in FIG. 7.
Figure 12B:
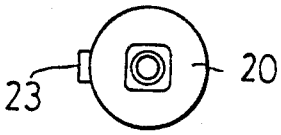
Figure 13:
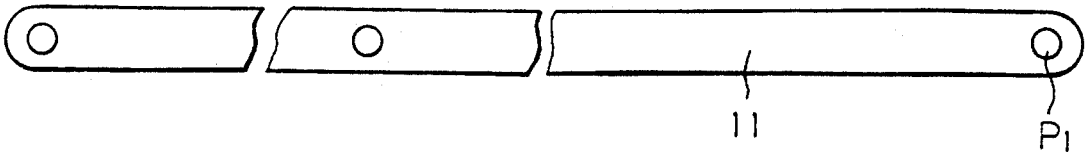
FIG. 13 is an explanatory drawing of an operational link.

The guide 10A shown in FIG. 8 and FIG. 11 appears from and disappears into the floor surface upon operation of the operational link 11 and the link 13, and plural guides are provided along the direction in which the hanging door moves. The guide 10B has the construction as shown in FIG. 7 and FIG. 12 and is set at the open position of the hanging door D.

In the guide 10A, a projecting guide piece 22 is fitted in an outer tube 20 whose bottom is fixed to the rail main body 1 by a screw 21. The guide piece 22 can be extended above the outer tube 20 so as to be visible, or retracted into the outer tube 20 so as to be invisible. When retracted, the guide piece 22 is flush with the top surface of the guide rail, and when extended, it is inserted into the long groove Da of the hanging door D. A pin 23 projecting from the projecting guide piece 22 is coupled with an end of the link 13 so that the projecting guide piece 22 can be made to appear and disappear upon operation of the link 13.

In the guide 10B, a spring 24 is interposed between the outer tube 20, which is fixed by a screw to the rail main body 1, and the projecting guide piece 22, so as to bias the projecting guide piece 22 to project upwardly. The extent of projection of the projecting guide piece 22 is restricted by the pin 23 and a slot, but the link 13 is not used.

Figure 2:
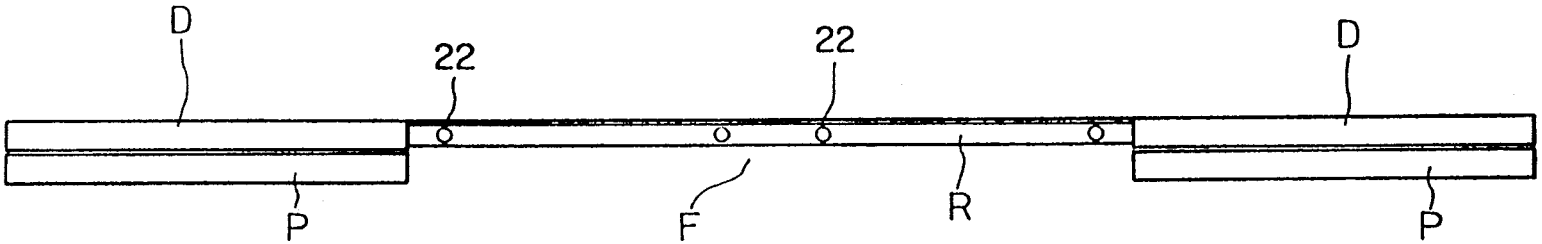
FIG. 2 is a plan view of the device in FIG. 1.

Therefore, in the guide rail device for hanging doors having such construction as mentioned above, while the hanging door is in the fully open state along the wall body P as shown in FIG. 1 and FIG. 2, a projecting guide piece of the guide 10B is inserted in the long groove Da at the lower end of the hanging door, but when the hanging door D is moved in the closing direction, the differential cam is pressed against by the operation projection 15 of the hanging door D and the differential cam is pivoted. As the operational link 11 is connected to the differential cam 12 and the projecting guide piece 22 of each guide 10A is connected to the operational link 11 by the link 13, the projecting guide piece 22 closing of the door causes the guide 10A to project from the floor surface. When the hanging door D moves in this state, since the guide of the guide rail is provided on a running locus of the hanging door D, the guide is naturally inserted into the long groove Da at the lower end of the hanging door D and thus deviation of the hanging door D is prevented.

Figure 3:
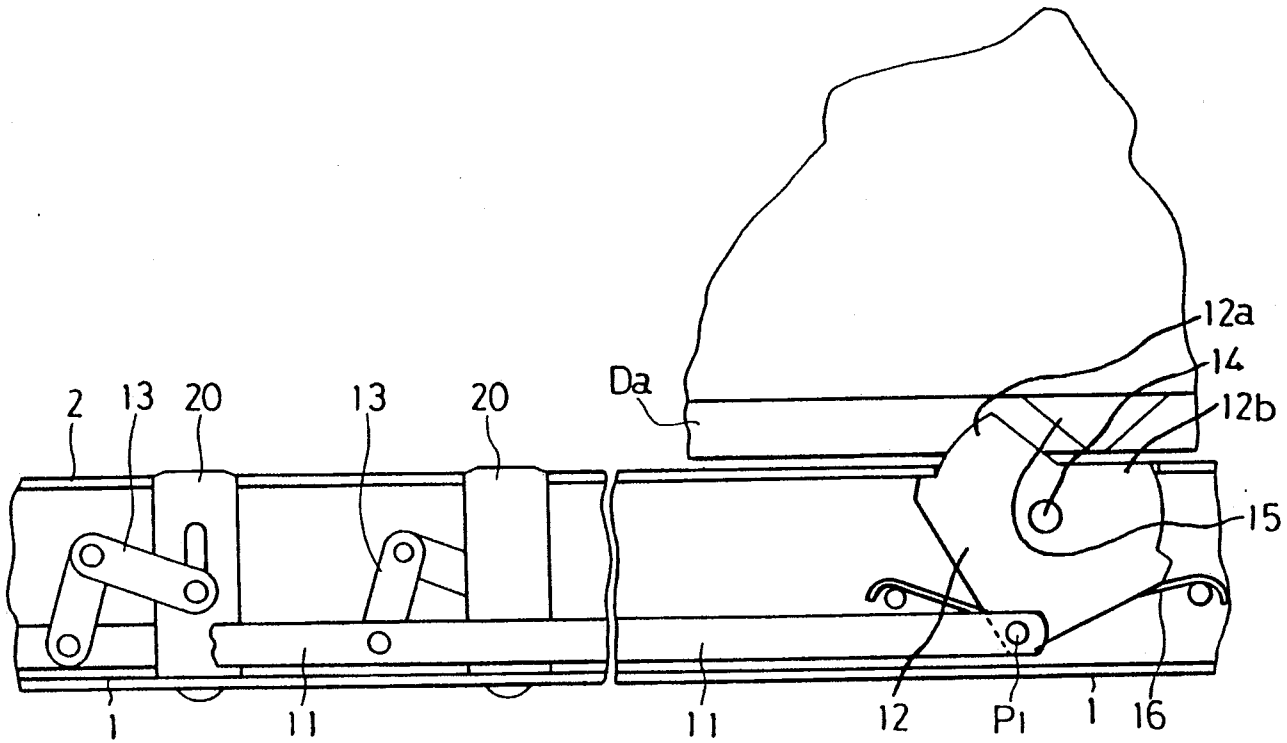
FIG. 3 is an explanatory drawing of a guide raising and lowering assembly, on an enlarged scale.

When the hanging door D is moved from its fully closed position to its fully open position as shown in FIG. 1, the differential cam 12 is pivoted about axis 14 in the clockwise direction as shown in FIG. 3 by the operation projection 15 of the hanging door D so that the projecting guide piece 22 is retracted into the guide rail in the floor surface by means of the operational link 11 and the link 13. At the fully open position, the guide 10B is inserted in the long groove Da at the lower end of the hanging door D.

Figure 14:
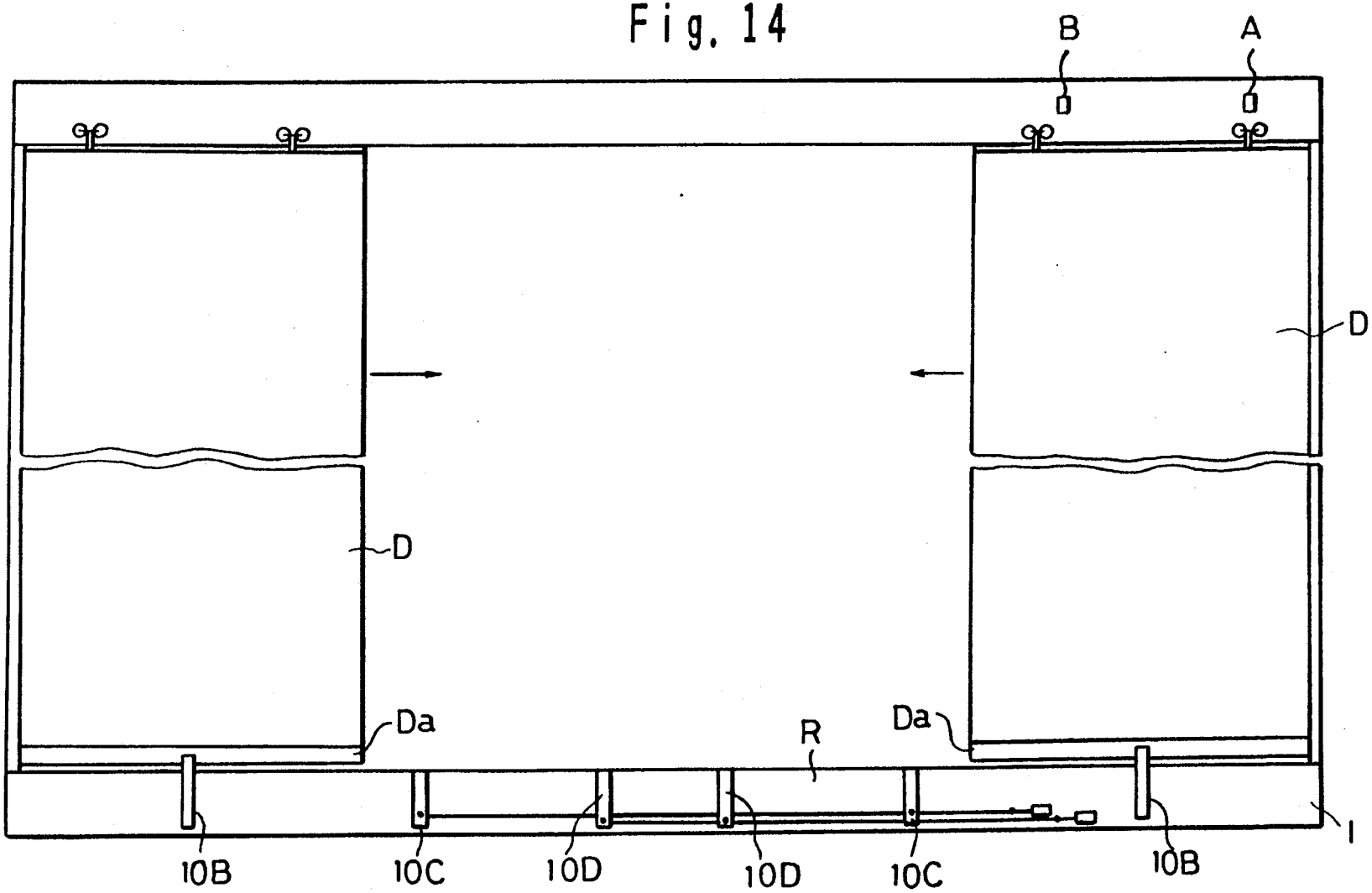
Figure 16:
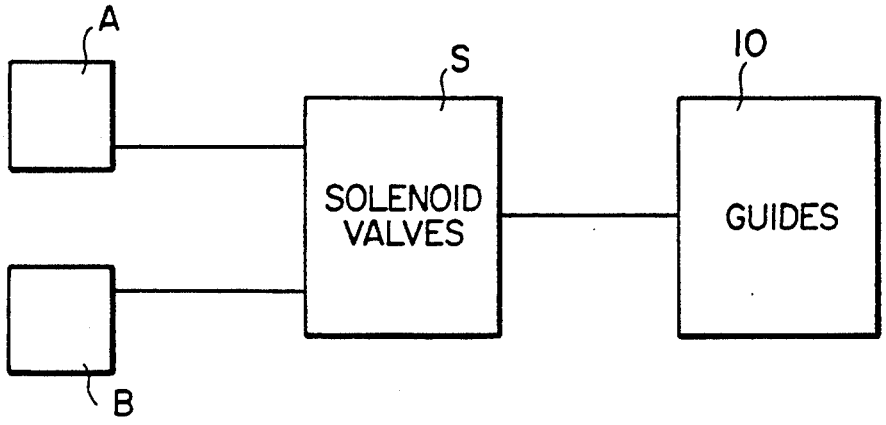
FIG. 16 is a schematic diagram of a detecting arrangement for the second embodiment.

FIG. 14 shows a second embodiment in which the guide is caused to appear and disappear electrically. A sensor or a switch is provided at the upper rail at position A for detecting the fully open position of the hanging door D and at the movement detecting position B for detecting movement of the hanging door from the fully open position to the fully closed position. A guide 10B and solenoid valves S (see FIG. 16) are provided in the guide rail embedded in the floor surface. The solenoid valves S are actuated by signals from the sensors or switches and guides 10C, 10D provided with the solenoid valves are caused to appear from or disappear into the guide rail, as in the case of the first embodiment.

Figure 15:
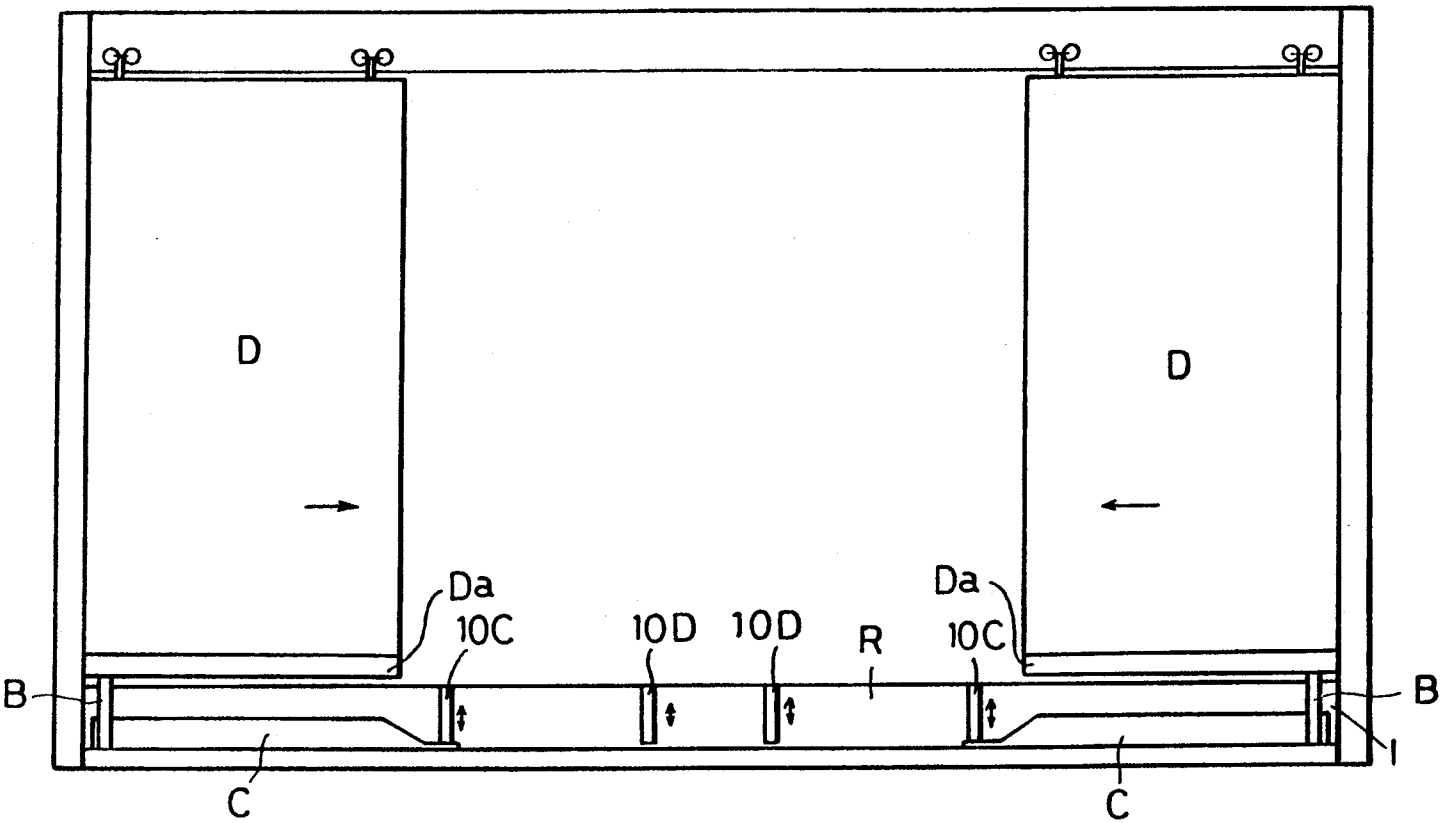
FIG. 15 is an explanatory drawing of a third embodiment of the invention.

FIG. 15 shows a third embodiment in which a bracket B is provided at a lower end of the hanging door D and a guide-raising cam link C is fitted to a lower end of the bracket B. As illustrated, the guide-raising cam link C is fitted slidably in the groove of the guide rail R and the top end surface of it is tapered so that when the hanging door D moves along the guide rail, it moves together with the guide-raising cam link C and the lower end surfaces of the guides 10C, 10D provided at the floor surface are pushed up, one after another, by the tapered surface of the cam link C and are supported by the top surface of the cam link C. The guides 10C, 10D are lower automatically by their own weight when the cam link C is retracted.

According to the present invention, a guide rail having guides movable between positions in which they are visible and invisible are embedded in the floor surface, and a long groove in which guides are fitted is formed at a lower end of the hanging door. Therefore, when the hanging doors are opened, guides enter into the guide rail in the floor surface such that there is no projection from the floor surface. When the hanging doors are closed, guides are projected from the floor surface and are fitted in the long groove. Thus, the hanging door is run accurately along the upper rail as guided by the guides projecting from the rail, yet when the hanging door is opened fully, the guides are forced to retract into outer tubes in the rail and thus cease to project upwardly from the floor surface.

What is claimed is:

1. A guide rail for use in guiding a sliding door having an elongated groove formed longitudinally along a bottom end surface thereof and being suspended from an upper rail so as to be slidable between open and closed positions, said guide rail comprising:

a guide rail main body adapted to be embedded in a floor beneath the bottom end surface of the sliding door;

a plurality of guide pieces vertically movably mounted in said guide rail main body for movement between extended positions, in which said guide pieces extend partially above an upper end of said guide rail main body and are adapted to extend into the elongated groove formed in the bottom end surface of the sliding door, and retracted position, in which said guide pieces are substantially retracted into said guide rail main body;

guide means for guiding said guide pieces to move only linearly vertically between said extended and retracted positions;

a cam member rotatably mounted in said guide rail main body for rotary movement between a door-open position and a door-closing position; and coupling means for operatively coupling said cam member to said guide pieces such that said guide pieces are moved to said extended positions when said cam member is rotated to said door-closing position and such that said guide pieces are moved to said retracted positions when said cam member is rotated to said door-open position.

2. A guide rail as recited in claim, further comprising an operation projection adapted to be mounted to the sliding door in the elongated groove, said operation projection constituting a means for rotating said cam member from said door-open position to said door-closing position when the sliding door is moved from its open position toward its closed position, and for rotating said cam member from said door-closing position to said door-open position when the sliding door is moved from its closed position to its open position.

3. A guide rail as recited in claim 1, further comprising a biasing means for biasing at least one of said guide pieces toward said extended position.

4. A guide rail as recited in claim 1, wherein said guide means comprises a plurality of outer tubes mounted in said guide rail main body, said guide pieces being vertically movably received in said outer tubes, respectively.

5. A guide rail as recited in claim 4, wherein a vertically extending slot is formed in a sidewall of each of said outer tubes; and a pin is mounted to each of said guide pieces and extends laterally therefrom and through a respective one of said slots, so as to constitute means for limiting vertical movement of said guide pieces, respectively.

6. A guide rail as recited in claim 1, wherein said coupling means comprises an elongated operational link pivotally coupled at one end thereof of said cam member and extending longitudinally through said guide rail main body, and a plurality of coupling links respectively coupled between said operational link and said guide pieces.

7. A guide rail as recited in claim 1, further comprising spring means for biasing said cam member toward said door-open position when said cam member is moved beyond a dead center position toward said door-open position, and for biasing said cam member toward said door-closing position when said cam member is moved beyond said dead center position toward said door-closing position.

8. A guide rail for use in guiding a sliding door having an elongated groove formed longitudinally along a bottom end surface thereof and being suspended from an upper rail so as to be slidable between open and closed positions, said guide rail comprising:

a guide rail main body adapted to be embedded in a floor beneath the bottom end surface of the sliding door;

a plurality of guide pieces vertically movably mounted in said guide rail main body for movement between extended positions, in which said guide pieces extend partially above an upper end of said guide rail main body and are adapted to extend into the elongated groove formed in the bottom end surface of the sliding door, and retracted positions, in which said guide pieces are substantially retracted into said guide rail main body;

detecting means for detecting movement of the sliding door into its open position and for detecting movement of the sliding door from its open position toward its closed position; and actuating means for moving said guide pieces for said retracted positions to said extended positions upon receiving an electric signal from said detecting means indicating that movement of the sliding door from its open position toward its closed position has been detected, and for moving said guide pieces from said extended positions to said retracted positions upon receiving an electric signal from said detecting means indicating that movement of the sliding door into its open position has been detected.

9. A guide rail as recited in claim 8, wherein said detecting means comprises a switch.

10. A guide rail as recited in claim 8, wherein said actuating means comprises solenoid valves operatively coupled to said detecting means and said guide pieces.

11. A guide rail as recited in claim 8, further comprising guide means for guiding said guide pieces to move only linearly vertically between said extended and retracted positions.

12. A guide rail for use in guiding a sliding door having an elongated groove formed longitudinally along a bottom end surface thereof and being suspended from an upper rail so as to be slidable between open and closed positions, said guide rail comprising:

a guide rail main body adapted to be embedded in a floor beneath the bottom end surface of the sliding door;

a plurality of guide pieces vertically movably mounted in said guide rail main body for movement between extended positions, in which said guide pieces extend partially above an upper end of said guide rail main body and are adapted to extend into the elongated groove formed in the bottom end surface of the sliding door, and retracted positions, in which said guide pieces are substantially retracted into said guide rail main body;

a guide piece-raising cam link slidably mounted in said guide rail main body for sliding movement longitudinally along said guide rail main body between a door-open position and a door-closed position, said guide piece-raising cam link having a tapered end constituting a means for engaging beneath and raising said guide pieces, one after another, from said retracted positions into said extended positions, respectively, as said guide piece-raising cam link is slid from said door-open position to said door-closed position; and coupling means for causing said guide piece-raising cam link to slide from said door-open position to said door-closed position when the sliding door is slid from its open position to its closed position, and for causing said guide piece-raising cam link to slide from said door-closed position to said door-open position when the sliding door is slid from its closed position to its open position.

13. A guide rail as recited in claim 12, wherein said coupling means comprises a bracket fixed to said guide piece-raising cam link and adapted to be fixed to the sliding door.

14. A guide rail as recited in claim 12, further comprising guide means for guiding said guide pieces to move only linearly vertically between extended and retracted position.

* * * * *